US007150243B1

(12) United States Patent
Greene

(10) Patent No.: US 7,150,243 B1
(45) Date of Patent: Dec. 19, 2006

(54) RAIL SYSTEM FOR A RACETRACK

(75) Inventor: William S. Greene, Louisville, KY (US)

(73) Assignee: Horsemen's Track & Equipment, Inc., Louisville, KY (US)

( * ) Notice: Subject to any disclaimer, the term of this patent is extended or adjusted under 35 U.S.C. 154(b) by 0 days.

(21) Appl. No.: 11/091,092

(22) Filed: Mar. 28, 2005

(51) Int. Cl.
*A63K 1/00* (2006.01)

(52) U.S. Cl. ..... 119/422

(58) Field of Classification Search ..... 256/1, 256/21, 22, 67, 65.14; 119/422, 502, 704, 119/705; 472/85, 86, 87
See application file for complete search history.

(56) References Cited

U.S. PATENT DOCUMENTS 2,315,516 A * 4/1943 Gray ..... 256/1
3,203,396 A * 8/1965 Carmichael, Jr. ..... 119/422
3,374,986 A * 3/1968 McElroy et al. ..... 256/59
4,610,432 A * 9/1986 Lewis et al. ..... 256/65.14
4,635,905 A * 1/1987 Fontana ..... 256/65.01
4,765,596 A * 8/1988 Fontana ..... 256/65.14
5,263,550 A * 11/1993 Jines et al. ..... 182/113
5,657,968 A * 8/1997 Marsden ..... 256/68
5,772,362 A * 6/1998 Sims ..... 405/232
6,715,425 B1 * 4/2004 Dore ..... 104/53

* cited by examiner

*Primary Examiner*—James R. Brittain
*Assistant Examiner*—Daniel Mills
(74) *Attorney, Agent, or Firm*—Stites & Harbison, PLLC; David W. Nagle, Jr.

(57) ABSTRACT

A rail system for a turf track allows for a simple and efficient reconfiguration of the rails to define a course over only a portion of the track. The rail system includes an inner rail and an outer rail, and further includes a series of intermediate posts for supporting a further rail that is adjustable to serve as either an inner rail or an outer rail in order to define a limited course over a portion of the track.

6 Claims, 3 Drawing Sheets

RAIL SYSTEM FOR A RACETRACK

BACKGROUND OF THE INVENTION

The present invention relates to a racetrack, and, more particularly, to a rail system for a turf track that allows for a simple and efficient reconfiguration of the rails to define a course over only a portion of the track.

A racetrack is typically bounded by a fence or other barrier to define the course and to separate the horses from spectators. As described in U.S. Pat. No. 4,443,002 (issued to Fontana), the earliest types of fencing were some form of wooden fences, such as post and rail, board fences, and in parts of England, even hedges and hedgerows. Although such wooden fencing was an effective barrier, upon impact of a horse or rider, the fence was inclined to break. Not only did this endanger spectators, but the accompanying splintering of the wooden materials created a hazardous and potentially lethal condition for the horse and/or rider.

As a result, over time, wooden fences were replaced by substantially continuous wooden or metal rails, which were supported by vertical posts at spaced intervals around the racetrack. Then, as a further improvement, the vertical posts were replaced with curved or inclined posts that extended inwardly over the racetrack, and thus, held the rail out some distance from the posts, to lessen the possibility that a horse or rider would strike the posts themselves. However, there remained significant safety concerns.

Now, in most modern day racetrack constructions, there is a fixed inner rail and a fixed outer rail that delineate the racetrack. Although the most common form of racetrack has a dirt/sand composition that serves as the "track cushion," some venues also have a turf track. Although any form of racetrack must be regularly and carefully maintained for the safety of the horse and their riders, a turf track requires especially intensive maintenance and upkeep efforts. Even if properly maintained, however, it is often necessary to limit use of the turf track because of the damage that is caused by repeated travel of horses over the turf.

For this reason, many racetracks use some form of temporary rail system to restrict use of the turf. For example, horses may be permitted only to practice on the outer portion of the track, while the inner portion of the track (nearest the rail) is used only for actual races. However, such temporary constructions require significant labor to assemble and disassembled.

Thus, there remains a need for a rail system that allows for a simple and efficient reconfiguration of the rails to define a limited course over a portion of the track.

SUMMARY OF THE INVENTION

The present invention is a rail system for a turf track that allows for a simple and efficient reconfiguration of the rails to define a course over only a portion of the track. The rail system includes a fixed inner rail and a fixed outer rail. The inner rail is supported by a plurality of posts at spaced intervals along the inner perimeter of the track, while the outer rail is similarly supported by a plurality of posts at spaced intervals along the outer perimeter of the track. These posts support sections of rail, collectively forming inner and outer barriers to define the course and to separate the horses from spectators. The exemplary rail system also includes a series of intermediate posts for supporting a further rail that is adjustable to serve as either an inner rail or an outer rail in order to define a limited course over a portion of the track. For each such post, a support spike is embedded into the underlying track surface, with an upper portion extending substantially vertically a fixed distance above ground level such that the post can be fit over the upper portion of the support spike. Because the posts simply slip over the support spikes, the posts can be oriented either to define a course between themselves and the fixed inner rail or to define a course between themselves and the fixed outer rail

DETAILED DESCRIPTION OF THE INVENTION

The present invention relates to a racetrack, and, more particularly, to a rail system for a turf track that allows for a simple and efficient reconfiguration of the rails to define a course over only a portion of the track.

Figure 1:
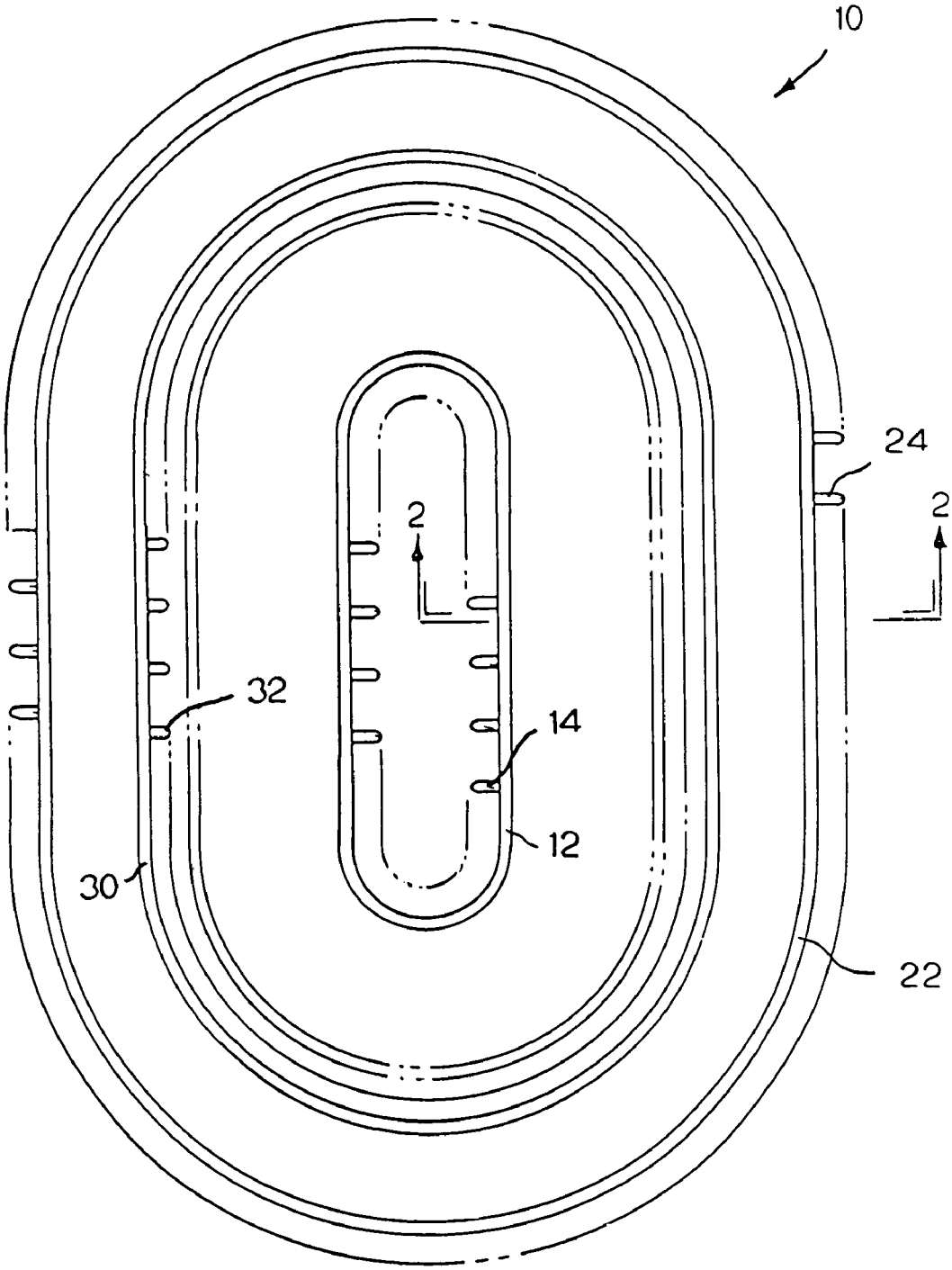
FIG. 1 is a schematic representation of a racetrack incorporating an exemplary rail system made in accordance with the present invention.
Figure 2:
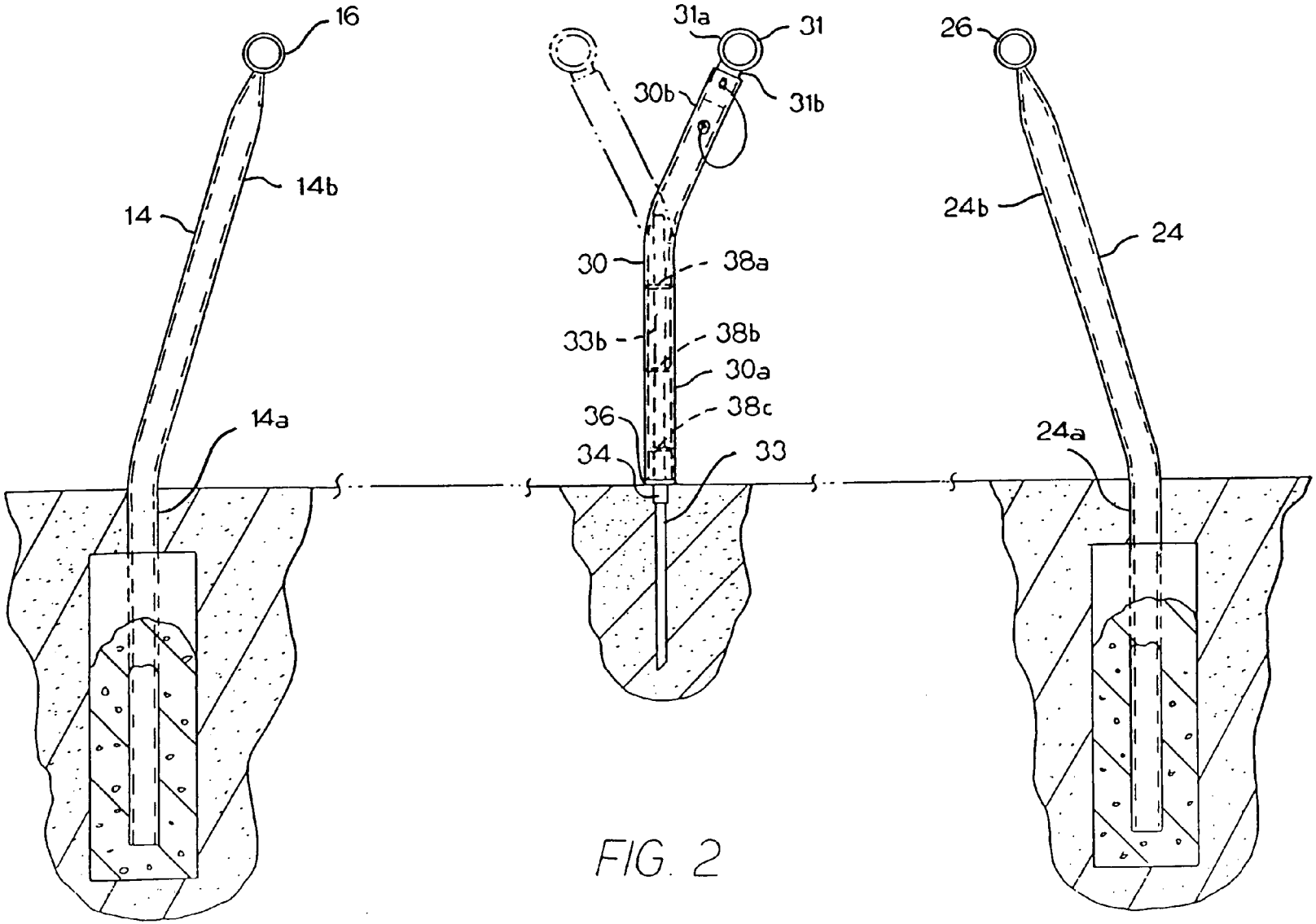
FIG. 2 is a sectional view taken along line 2—2 of FIG. 1.

FIG. 1 is a schematic representation of a racetrack incorporating an exemplary rail system 10 made in accordance with the present invention. This rail system 10 includes a fixed inner rail 12 and a fixed outer rail 22, which is no different that any common rail construction for a racetrack. The inner rail 12 is supported by a plurality of posts 14 at spaced intervals along the inner perimeter of the track, while the outer rail 22 is similarly supported by a plurality of posts 24 at spaced intervals along the outer perimeter of the track. As illustrated in FIG. 2, each post 14, 24 includes a lower portion 14*a*, 24*a* that is embedded into concrete or a similar support material and an upper inclined portion 14*b*, 24*b* that extends over the track. These posts 14, 24 support sections of rail, collectively forming inner and outer barriers to define the course and to separate the horses from spectators. In this exemplary embodiment, the upper inclined portion 14*b*, 24*b* of each post 14, 24 terminates in a sleeve 16, 26, which is oriented substantially parallel to the underlying track and receives and retains the respective ends of two adjacent rail sections.

Figure 3:
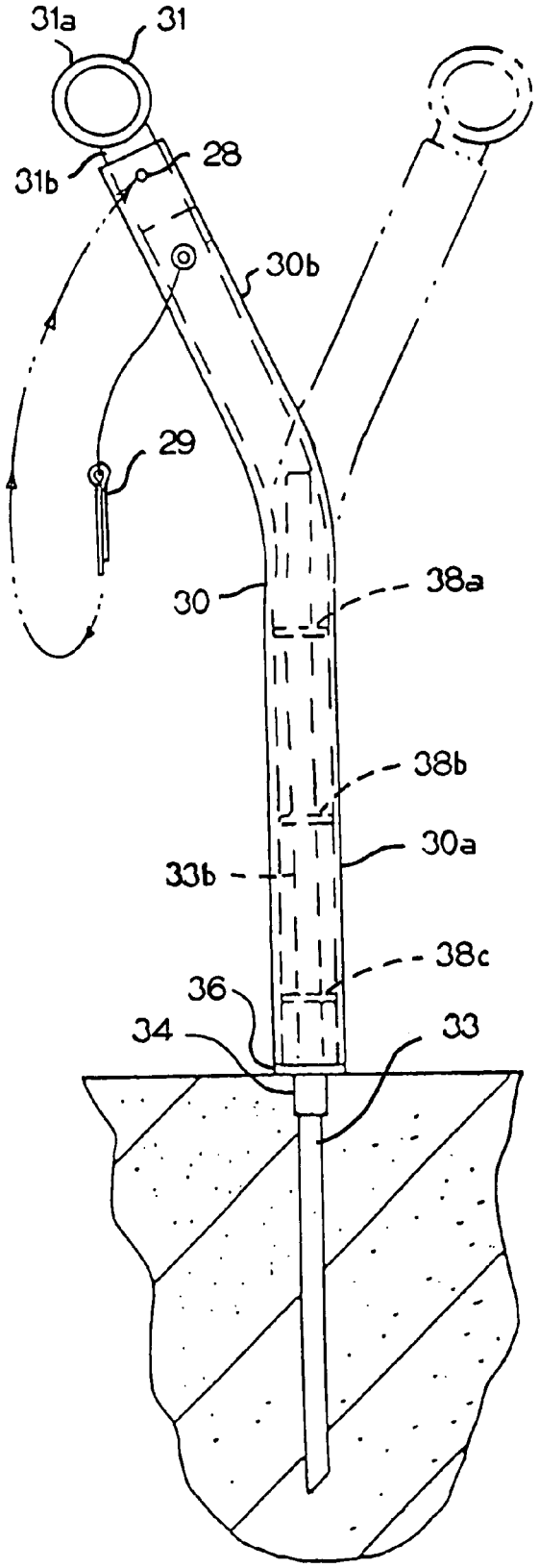
FIG. 3 is an enlarged sectional view of one of the intermediate posts of the exemplary rail system of FIG. 1.

Referring still to FIGS. 1 and 2, the exemplary rail system 10 also includes a series of intermediate posts 30 for supporting a further rail 32 that is adjustable to serve as either an inner rail or an outer rail in order to define a limited course over a portion of the track. Each post 30 includes a lower portion 30*a* and an upper inclined portion 30*b*. Referring now to the enlarged sectional view of one of the intermediate posts 30 in FIG. 3, rather than the lower portion 30*a* of the post 30 being embedded into concrete or a similar support material, a support spike 33 is embedded into the underlying track surface, with an upper portion 33*b* extending substantially vertically a fixed distance above ground level. The post 30, which is substantially hollow, can thus be fit over the upper portion 33*b* of the support spike 33. In this regard, because the posts 30 simply slip over the support spikes 33, the posts 30 can be oriented either to define a course between themselves and the fixed inner rail 12 (as illustrated in FIG. 3 and in phantom in FIG. 2), or to define a course between themselves and the fixed outer rail 22 (as illustrated in FIG. 2 and in phantom in FIG. 3). Again, as with the fixed inner and outer rails 12, 22 described above, the upper inclined portion 30*b* of each post 30 terminates in a sleeve 31, which is oriented substantially parallel to the underlying track and receives and retains the respective ends of two adjacent rail sections. Furthermore, in this exemplary embodiment, the sleeve 31 can be readily removed from the post 30. In this regard, the sleeve 31 includes not only an upper portion 31*a* that is oriented substantially parallel to the underlying track and receives and retains the respective ends of two adjacent rail sections, but also includes a lower portion 31*b* that is adapted to fit into the end of the hollow post 30. Accordingly, the sleeve 31 can be readily connected to or removed from the post 30. Furthermore, when received in the post 30, as illustrated in FIGS. 2 and 3, a pin 29 may be passed through an opening 28 defined by the post 30, through corresponding openings in the lower portion 31*b* of the sleeve 31, and out a second opening (not shown) on the opposite side of the post 30, to secure the sleeve 31 relative to the post 30.

Figure 4:
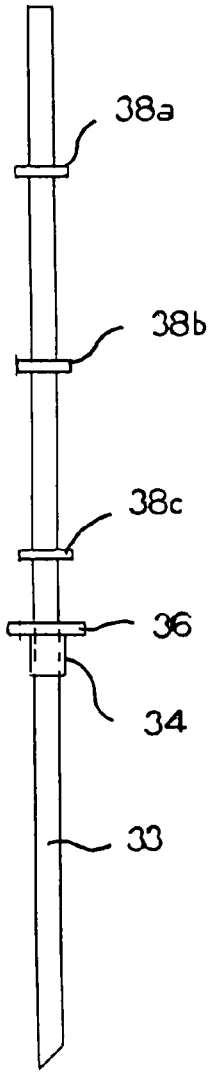
FIG. 4 is a side view of the support spike for the intermediate post of FIGS. 2 and 3.

FIG. 4 is a side view of the support spike 33 for the intermediate post 30 of FIGS. 2–3. As shown, a sleeve 34 with an upper flange 36 fits around and is welded or otherwise secured to the support spike 33. Referring back to FIGS. 2 and 3, the support spike 33 is driven into the underlying track surface until this flange 36 is flush with the track surface, thus ensuring that the support spikes 33 and the associated posts 30 are at the appropriate and consistent height. Furthermore, this exemplary support spike 33 is also provided with multiple washers 38*a*, 38*b*, 38*c* at predetermined locations along the length of the support spike 33. These washers 38*a*, 38*b*, 38*c* each have an outer diameter that is marginally less that the inner diameter of the hollow post 30 that is to be fitted over the support spike 33, and as such, maintains the post 30 in a substantially stable, upright position.

Referring still to FIG. 4, this exemplary support spike 33 extends beyond the uppermost washer 38*a*, and as illustrated in FIG. 3, into the bend between the lower portion 30*a* and the upper portion 30*b* of the post 30, which substantially impedes free rotation of the post 30 around the support spike 33. Of course, once the rails (not shown) are received in the sleeves 31 of the respective posts 30, rotation of a post 30 around its support spike 33 is prevented.

Figure 5:
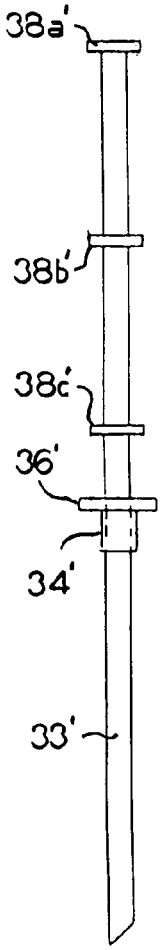
FIG. 5 is a side view of an alternate support spike.

FIG. 5 is a side view of an alternate support spike 33', which in most aspects is identical to the support spike of FIGS. 2–4, but does not include any extension beyond the uppermost washer 38*a'*.

In practice, the support spikes 33 described above remain in place at some fixed distance between the fixed inner rail 12 and the fixed outer rail 22. The intermediate posts 30 are then fitted over the respective support spikes 33. If these intermediate posts 30 are used to define a course over the inner portion of the track, they are oriented as illustrated in FIG. 3 to define a course between themselves and the fixed inner rail 12. Rail sections are then interposed between and connected to the respective posts 30 to complete the rail construction of this "outer rail." If and when the inner portion of the track becomes damaged and requires maintenance, the rail sections can be removed from between the respective posts 30. Then, each intermediate post 30 is lifted (but not necessarily removed) and turned 180° so that it can support an "inner rail" with the course being defined between the intermediate posts and the fixed outer rail 22, as illustrated in FIG. 2.

One of ordinary skill in the art will also recognize that additional embodiments are possible without departing from the teachings of the present invention or the scope of the claims which follow. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A rail system for a racetrack, comprising:

a fixed inner rail;

a fixed outer rail; and an adjustable intermediate rail, including a plurality of support spikes, a plurality of posts fitted over said support spikes, each said post including a lower portion that is adapted to be fit over one of said support spikes and an upper inclined portion, and a plurality of rail sections interposed between and connected to said posts, wherein, in a first orientation, said intermediate rail defines a course between itself and the fixed inner rail with the upper inclined portion of each post extending over the course, and, in a second orientation, said intermediate rail defines a course between itself and the fixed outer rail with the upper inclined portion of each post extending over the course; and wherein said adjustable intermediate rail is transitioned from the first orientation to the second orientation by removing the rail sections interposed between and connected to said posts, turning each approximately 180°, and reconnecting the rail sections between the respective posts.

2. The rail system for a racetrack as recited in claim 1, wherein the upper inclined portion of each post terminates in a sleeve, said sleeve having an upper portion for receiving and retaining ends of two adjacent rail sections, and a lower portion that is adapted to fit into the post, such that the sleeve can be disconnected and removed from the post to facilitate transitioning of the adjustable intermediate rail from the first orientation to the second orientation.

3. The rail system for a racetrack as recited in claim 2, wherein said adjustable intermediate rail further includes a plurality of pins for connecting each said sleeve to the upper inclined portion of the associated post.

4. The rail system for a racetrack as recited in claim 3, wherein each said pin passes through an opening defined by the post, through corresponding openings in the lower portion of said sleeve, and out a second opening on the opposite side of the post.

5. The rail system for a racetrack as recited in claim 1, wherein each support spike is provided with one or more washers at predetermined locations along the length of the support spike, each such washer having an outer diameter that is marginally less than an inner diameter of the post that is to be fitted over the support spike, and as such, maintains the post in a substantially stable, upright position.

6. The rail system for a racetrack as recited in claim 1, in which there is a sleeve with an upper flange that fits around and is secured to each support spike, such that, when the support spike is driven into an underlying ground surface, the flange rests on the ground surface.

* * * * *